US005860242A

United States Patent [19]

O'Neil

[11] Patent Number: 5,860,242

[45] Date of Patent: Jan. 19, 1999

[54] REMOVABLE HARMONIC TUNING SYSTEM FOR FIREARMS

[76] Inventor: Pat O'Neil, 5618 Shoalwood, Austin, Tex. 78756

[21] Appl. No.: 923,589

[22] Filed: Sep. 4, 1997

[51] Int. Cl.[6] ..... F41C 27/22

[52] U.S. Cl. ..... 42/97; 42/97; 42/75.01; 89/14.3

[58] Field of Search ..... 42/97, 94, 75.01, 42/75.02, 75.03, 75.04, 79; 89/14.3

[56] References Cited

U.S. PATENT DOCUMENTS

| | | | |
|---|---|---|---|
| Re. 035,381 | 11/1996 | Rose | 42/97 |
| 2,796,005 | 6/1957 | Shapel | 89/14 |
| 4,057,924 | 11/1977 | Joseph | 42/75 |
| 4,211,146 | 7/1980 | Bradley | 89/16 |
| 4,392,413 | 7/1983 | Gwinn | 89/14 |
| 4,510,843 | 4/1985 | Rabatin | 89/14.4 |
| 4,643,073 | 2/1987 | Johnson | 89/14.3 |
| 4,726,280 | 2/1988 | Frye | 89/16 |
| 4,771,833 | 9/1988 | Honsa | 173/162.1 |
| 4,813,333 | 3/1989 | Garris et al. | 89/14.3 |
| 4,913,031 | 4/1990 | Bossard et al. | 89/14.3 |
| 4,942,801 | 7/1990 | Schuemann | 89/14.3 |
| 5,092,223 | 3/1992 | Hudson | 89/14 |
| 5,279,200 | 1/1994 | Rose | 89/14.5 |
| 5,355,765 | 10/1994 | Rogers | 89/14.4 |
| 5,423,145 | 6/1995 | Nasset | 42/75.01 |
| 5,425,298 | 6/1995 | Coburn | 89/14.3 |
| 5,509,345 | 4/1996 | Cyktick | 89/14.05 |
| 5,666,756 | 9/1997 | Moller | 42/79 |
| 5,698,810 | 12/1997 | Rose | 42/97 |

*Primary Examiner*—Charles T. Jordan
*Assistant Examiner*—Denise J. Buckley

[57] ABSTRACT

A tubular shaped collar (22) of predetermined mass having internal threads (23) and an internal tapered area (21) which is threaded onto a tubular shaped insert (26) of flexible composition that has threads (44) that match the threads (23) of the collar and is tapered in a manner to match the taper (21) of the collar. The insert has a plural of longitudinal slits (25) in the tapered area. The insert is threaded into the collar and the collar and insert are slid over the muzzle end of a firearm barrel where they are locked in place by tightening the collar onto the insert whereby the predetermined angle of the taper (21) of the collar compresses the insert tightly against a firearm barrel. The insert and collar are adjustably positioned on the firearm barrel and held in place while being tightened by a tubular shaped tool (32) which has means of mating with the insert and has a means of calibration to determine the relative position of the collar and insert on a firearm barrel. The collar and insert are moved axially along the firearm barrel to a location whereby the predetermined mass of the collar will tune the harmonic vibrations of the firearm barrel and promote greater accuracy.

15 Claims, 8 Drawing Sheets

Figure 4 (A-D)

REMOVABLE HARMONIC TUNING SYSTEM FOR FIREARMS

BACKGROUND

1. Field of Invention

The present invention relates to a removable system that allows altering or tuning of the harmonic vibration pattern of a wide variety of firearm barrels which imparts an improvement to the accuracy of a firearm such equipped with no modification or alteration to the barrel.

2. Background and Description of Prior Art

Upon discharge, a firearm barrel begins a pattern of harmonic vibrations moving from chamber to muzzle and back. This vibration pattern is affected by the volume of the powder charge, the weight of the bullet, the design of the bullet shape, the seating depth of the bullet in relation to the bore, the rifling twist, the diameter of the barrel and the way in which the action and barrel are mounted to the stock of the firearm.

Each new combination of elements, such as changing from one brand of ammunition to another or changing bullet weight or bullet style will impart a new vibration pattern to the barrel. With each new combination the accuracy of the firearm can be affected. The normal shape of an impact pattern on a downrange target shows that the actual vibration pattern of the firearm muzzle is circular in nature around the axis of the bore. This circular vibration is caused by the spin imparted to the bullet by the spiral rifling in the bore. Additional vibrations are imparted by the sound created by the discharge of the propellant as well. This vibration pattern is present along the entire length of the barrel and moves in a wave motion along the axis of the bore in a series of vibration patterns. These patterns move first toward the muzzle along the barrel and then away from the muzzle, thus creating a harmonic effect not unlike a tuning fork.

Upon firing, if the bullet departs the muzzle at the greatest point of circular deflection in the harmonic vibration pattern the size of the impact pattern will be larger than if the bullet were to depart while the muzzle is at it's smallest circular deflection. Firearms designed for target shooting are normally equipped with a very heavy barrel of large diameter to minimize the vibration pattern and impart greater accuracy. Hunting firearms are designed with smaller diameter light weight barrels to provide greater portability and are therefore less likely to be accurate with all types of ammunition due to varying vibration patterns.

To a lesser extent, the design of the crown of the muzzle or what is actually beyond the end of the bore can affect accuracy as well. This is known as muzzle dynamics and deals with the action of expanding gases on the base of the bullet once it has departed the bore.

The harmonic vibration characteristics of a barrel can be altered by changing ammunition, changing the length of the barrel, changing the point at which a barrel contacts the forestock of the firearm or by changing the diameter or mass of the barrel.

Previously the reduction or control of barrel vibration has been approached in numerous ways. A Ballistic Optimizing System for Rifles (BOSS) patented by Rose of South Weber, Utah, U.S. Pat. No. 5,279,200 utilizes a permanently attached tube with vents or ports that can be adjusted to tune the vibration pattern of the barrel used in conjunction with a flexible barrel and action bedding compound where these contact the stock of the firearm. Unfortunately, this device is available only by purchasing a Browning or Winchester rifle equipped with the system. The most obvious drawback to this device is that it affords no improvement to a shooter's current firearm. If it were available, it would require permanent alteration of the barrel of the gun, another drawback that affects future value of a gun. Contrary to the patent claims, the BOSS also increases muzzle blast noise, it deflects propellant gas rearward with it's series of ports and even warns of the noise increase in advertising literature covering the BOSS system. Such additional noise can create a hazard for the shooter and any nearby observers. Another drawback to the BOSS is increased overall length since it is mounted such that it extends beyond the end of the muzzle. Since the BOSS is a permanent attachment, it cannot be removed and mounted on another gun. Were the BOSS available as an aftermarket product, it would require gunsmith installation and permanent modification to the barrel as well as permanent modification of the gunstock in applying the required flexible bedding compound. The BOSS system also has an effect on the muzzle dynamics of the gun that change with each new adjustment of the device.

A follow-up device similar to the BOSS U.S. Pat. No. 5,509,345 by Cyktich of Everett, Wash. also requires mounting a device substantially beyond the end of the muzzle. This device also has porting and was more or less permanently mounted onto the barrel of the gun with a type of heat shrink material. Drawbacks include increase in muzzle blast, it is not transportable from gun to gun, it requires a custom sized mounting device for each barrel, and an increase in overall length of a gun so equipped.

A Rifle Control Tube as patented by Shapel of Boise, Id. U.S. Pat. No. 2,796,005 utilized a combination of weight for dampening effect coupled with a system of vents to deflect propellant gases upward to reduce muzzle flip and recoil. The drawback to this system is the permanent modification necessary to the barrel of the gun, namely threading the muzzle for mounting. In addition, the venting system creates an increase in noise due to the deflection of muzzle blast. The system had no means of actually changing or tuning the vibration pattern to impart better accuracy with different types of ammunition. A further drawback to this type of system is the change in muzzle dynamics whereby the bullet departing the bore can be affected by deflected propellant gases. Another drawback is the additional length added to the barrel which makes gun handling more difficult. This device cannot be removed from one gun and placed on another without permanent barrel modification. This device could not be installed by an untrained shooter, and requires a professional to modify the firearm and mount the device.

Other means of dampening barrel vibration have been used. U.S. Pat. No. 4,726,280 by Frye relates to a means of mounting a muzzle member by threading the end of the barrel. This muzzle member could add sufficient weight to dampen or alter the vibration of the barrel, however, a permanent modification to the gun barrel is required. A further drawback is the additional length added to the gun. In addition, this device can adversely affect the muzzle dynamics of a firearm so equipped. This device also lacks the ability to be adjusted to tune the vibration pattern of the barrel for best accuracy.

Other muzzle "Brakes" have been utilized to lessen the recoil of a firearm by venting propellant gases in an attempt to offset rearward movement at discharge. These devices all require permanent modification of the gun barrel and cannot be attached by the average shooter. While most of these devices can add some weight to the end of the barrel, they all lack the ability to be adjusted or tuned for optimum accuracy. In many instances, barrels that have been modified and a muzzle brake added no longer shoot as accurately as before. All these devices tend to increase muzzle blast by deflecting propellant gases rearward toward the shooter.

A more recent development in an attempt to alter barrel vibration without adding significant weight was developed by Christianson Arms of Fayette, Utah (patent pending). This approach encases the entire barrel with a carbon fiber sleeve that adds stiffness to reduce barrel vibration. This design effectively creates a heavy barrel characteristic without the associated weight of a larger diameter barrel. The drawback to this system is high cost of a complete rifle. If the system were available as an aftermarket modification it would require barrel replacement and as a further drawback this barrel has no capability of adjusting or tuning for different types of ammunition because even heavy barrels have a certain amount of vibration to contend with.

U.S. Pat. No. 5,423,145, by Nasset of Aumsville, Oreg. is a device that tunes barrel vibrations by altering the contact point of the barrel to the forestock. This effectively changes the length of the vibration pattern from contact point to muzzle thus changing barrel harmonics. This system requires permanent modification of the gunstock which can affect future value. Another drawback is the device cannot be moved from gun to gun. Also, any barrel contact by the stock can affect point of impact if the stock gets wet. Wood stocks can swell and warp, fiberglass or composite stocks are stable in all conditions, but any moisture between the barrel and the contact point will affect the point of impact due to hydraulic effect. This device is also best installed by a competent gunsmith since a good deal of stock material must be removed from the barrel channel for installation and the barrel contact must be accurately centered below the barrel with a certain amount of pressure on the contact point.

Another approach to barrel vibration is addressed by American Safe Arms, Inc. as described in the January 1997 issue of Shooting Sports Retailer. This method is a complete redesign of the entire gun barrel. It has an inner barrel encased by an outer sleeve or barrel with a device at the muzzle that keeps the inner barrel stationary. The inner barrel is ported to direct propellant gases out and back inside the inner sleeve. This design lowers noise and reduces recoil at the same time. While a unique approach to the problem, the system is not something that a shooter can install themselves on their existing firearm. Another drawback is the lack of tuning capability within the system. This system obviously has no flexibility to move from gun to gun.

Another approach is an embodiment of the present invention as produced by Bill Shaw of Austin, Tex. in February of 1997. This proof of concept prototype was constructed for me by Mr. Shaw from my original drawings but he modified the design considerably. Mr. Shaw used a custom designed insert that was press fit onto the barrel and externally threaded to accept a tuning device of a nominal weight. The drawback to this design was the need for custom sized inserts for each different size barrel and no indexing capability for adjustments to the location of the tuning device. A further drawback was the lack of transportability between guns because a custom sized insert would be required for each.

In addition to these systems mentioned, the search for accuracy improving products has run to other types of devices such as improved bench rest devices, improved stock mounting systems, improved stock materials that are more stable under all conditions, interchangeable barrel weights of different sizes to dampen vibration, and custom tailored ammunition to match each gun specifically. All lack the ability to tune barrel vibrations with the same device and the ability to transport the device from gun to gun without custom modifications.

OBJECTS AND ADVANTAGES

It is a principle object of the present invention to provide a removable harmonic tuning system for firearms that can be infinitely adjusted to tune the harmonic vibration pattern of a wide variety of gun barrels which promotes the greatest accuracy with any given ammunition.

Another important object of the invention is to provide transportability from one firearm to another in such a way as to not require any permanent attachment to a firearm barrel.

Still another important object of the invention is to provide a means of mounting the system that will accommodate a wide variety of different muzzle diameters without resorting to custom mounting hardware for each different size barrel.

A further important object of the invention is a system that when removed from the barrel leaves no marks or marring on the barrel of the firearm which could affect future value.

Still another important object of the system is to accomplish the desired firearm tuning characteristics without any part of the system extending beyond the muzzle of the firearm thereby affecting the muzzle dynamics and increasing the overall length of the firearm.

OBJECTS AND ADVANTAGES CONTINUED

A further important object of the system is to not eliminate or dampen the vibration pattern of the barrel of the firearm but to alter it.

Still another object of the invention is to provide a means of adjustment that will allow the system to be removed from a firearm and later reattached at the same point of adjustment without alteration to the firearm.

A further important object of the Invention is that there is no increase in the noise level of the firearm when equipped with the system.

Still another object of the invention allows for cooling air to circulate between components of the system and the barrel of the firearm.

A further important object of the Invention is that the system will not affect sighting through a telescopic sight.

Still another object of the invention is that the system can be mounted and adjusted without the use of any additional tools.

A further important object of the invention is that it works without the need for any special bedding materials between the stock and barrel or action of the firearm.

Additional objects and advantages of the invention will become more apparent upon further discourse.

REFERENCE NUMERALS IN DRAWINGS

Figure 1:
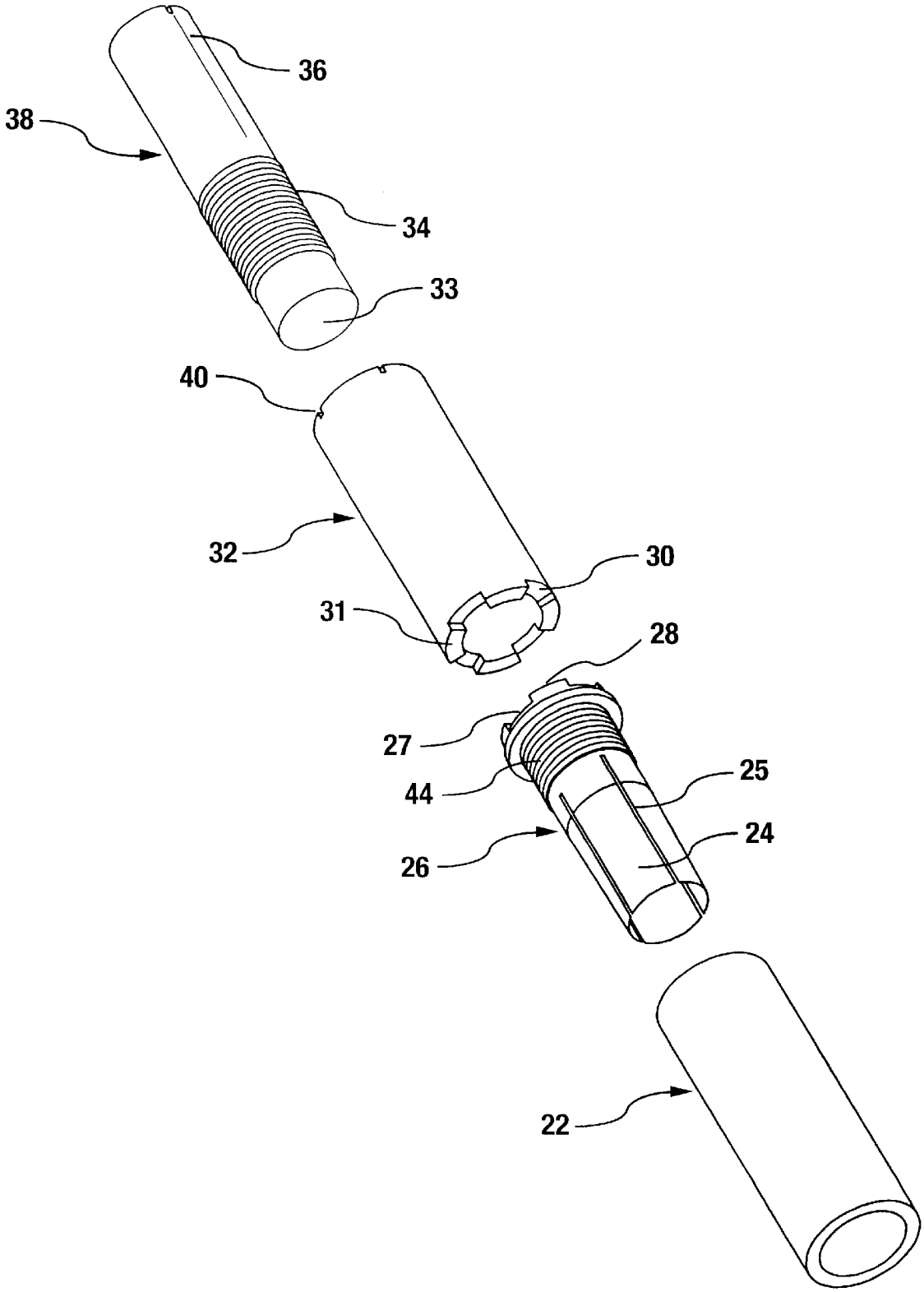
FIG. 1 shows a perspective view of the individual parts of the invention.

20 Rifle Barrel
21 Internal Collar taper
22 Collar
23 Internal Collar Threads
24 Insert Compression Petals
25 Expansion Slits
26 Compression Insert
27 Insert face Slots
28 Insert face
29 Adjusting tool Internal Threads
30 Adjusting Tool Face
31 Adjusting Tool Face Tabs
32 Adjusting Tool Body
33 Pilot Rod Face
34 Pilot Rod Threads
36 Pilot Adjustment Reference Mark
37 Pilot Rod Turn Indicators
38 Pilot Rod
40 Index Marks
42 Insert to Collar reference point
44 Insert Threads
46 Collar to Insert reference points (four)
48 Muzzle Crown
50 Test target without device (.22-250)
51 Test target device even with muzzle (.22-250)
52 Test target device adjusted ½ turn (.22-250)
53 Test target device adjusted 1 turn (.22-250)
54 Test target device adjusted 1 & ½ turn (.22-250)
55 Test target device adjusted 2 turns (.22-250)
56 Test target without device (.220 Swift)
57 Test target device even with muzzle (.220 Swift)
58 Test target device adjusted ½ turn (.220 Swift)
59 Test target device adjusted 1 turn (.220 Swift)
60 Test target device adjusted 1 & ¼ turn (.220 Swift)
61 Test target device adjusted 1 & ½ turn (.220 Swift)
62 Test target device adjusted 2 turns (.220 Swift)
63 Test target device adjusted 1 turn (.220 Swift)
64 Test target without device (30-06)
65 Test target device even with muzzle (30-06)
66 Test target device adjusted ½ turn (30-06)
67 Test target device adjusted 1 turn (30-06)
68 Test target device adjusted 1 & ½ turn (30-06)
69 Test target device adjusted 1 & ¾ turn(30-06)

SUMMARY

The present invention addresses the needs of shooters who do not wish to either purchase a new firearm in order to be able to tune their barrel vibrations, as well as addressing the needs of the shooters who do not wish to permanently after their firearm to achieve greater accuracy. The removable harmonic tuning system will allow many shooters the ability to tune their barrel vibration patterns to achieve the greatest accuracy with any given ammunition and will still afford them the ability to remove the system and place it on a second firearm, all with no modification to the firearm. The removable harmonic tuning system will not mar the finish on their barrel, will not extend the length of their firearm, will not affect muzzle dynamics, will not increase noise levels, and most importantly it will not affect the future value of the firearm. The system is a significant alternative to expensive professional alterations such as muzzle brakes, special stocks, special bedding systems, or the purchase of a new firearm.

According to the present invention, I alter the harmonic barrel vibration characteristics of a firearm by mounting an outer tube or collar of a nominal weight near the muzzle of the rifle barrel by means of an inner adjustable compression insert or insert that surrounds the barrel. The collar is tubular to provide an equal amount of weight completely around the circumference of the barrel. The insert has 2 or more tapered flexible compression petals or petals which will compress against the barrel when properly mounted. The insert is made of a resin based material that will not affect the finish on the rifle barrel. The insert is compressed against the barrel by tightening the outer collar onto the insert by means of threads inside the collar that mate to threads on the outside of the insert. The collar's inner surface is tapered and matches a corresponding taper on the outer surface of the insert's compression petals. This taper causes the collar to compress the insert's compression petals when tightened, making the compression petals grip the barrel tightly. This compression holds the collar and insert in place when the firearm is fired. The taper on the compression petals allow one size insert to be able to grip a variety of different barrel diameters.

The harmonic vibration characteristics of the barrel are changed by moving the collar and insert to different locations along the axis of the barrel near the muzzle. The nominal weight of the collar acts as a small amount of additional mass on the barrel and by moving this mass closer or further away from the muzzle, the vibration is altered. When the device is positioned in the proper location, the vibration pattern will be altered to cause the least amount of circular deflection of the muzzle upon firing thus resulting in the best accuracy possible with a particular ammunition.

The position of the collar and insert on the barrel is determined by an adjusting tool which regulates the distance from the muzzle that the collar and insert are placed. Once a tuning location is determined from test firing, the collar and insert can be removed and placed on another firearm. Should the shooter wish to return the system to the original firearm, all that must be remembered is the previous settings for the original firearm.

The removable harmonic tuning system allows the flexibility to be moved from one gun to another, something that has not been previously available. In addition, according to exhaustive testing, the system will work equally well on any caliber of firearm. With increasingly higher acquisition costs for firearms and the high cost of professional modifications to such firearms, a tuning system that will work equally well from one gun to the next is a cost effective means of providing improved accuracy without having to buy a new system for each firearm owned.

DESCRIPTION—FIGURES 1–7

The typical embodiment of the individual parts of the present invention are illustrated in FIG. 1 (perspective view) and FIG. 4 (side view). There is a Collar 22 made of a material of suitable strength and predetermined mass which has internal threads 23 and an internal tapered section 21. There is a compression insert 26 which is made of a resin based material which is flexible yet strong enough to allow for it's external threading 44. The collar 22 has 4 reference marks 46 on it's outer surface. There is a single reference point 42 on the compression insert. The compression insert has 4 or more compression petals 24 which are tapered on the outside. There are expansion slits 25 in the compression insert. The face 28 of the compression insert has multiple slots 27. There is an adjusting tool 32. There are 4 Index marks 40 on the adjusting tool body. There are multiple tabs 31 on the face 30 of the adjusting tool. There is a pilot rod 38 that has external threads 34. The pilot rod has an adjustment reference mark 36 and a turn indicator 37.

Figures 1, 1A:
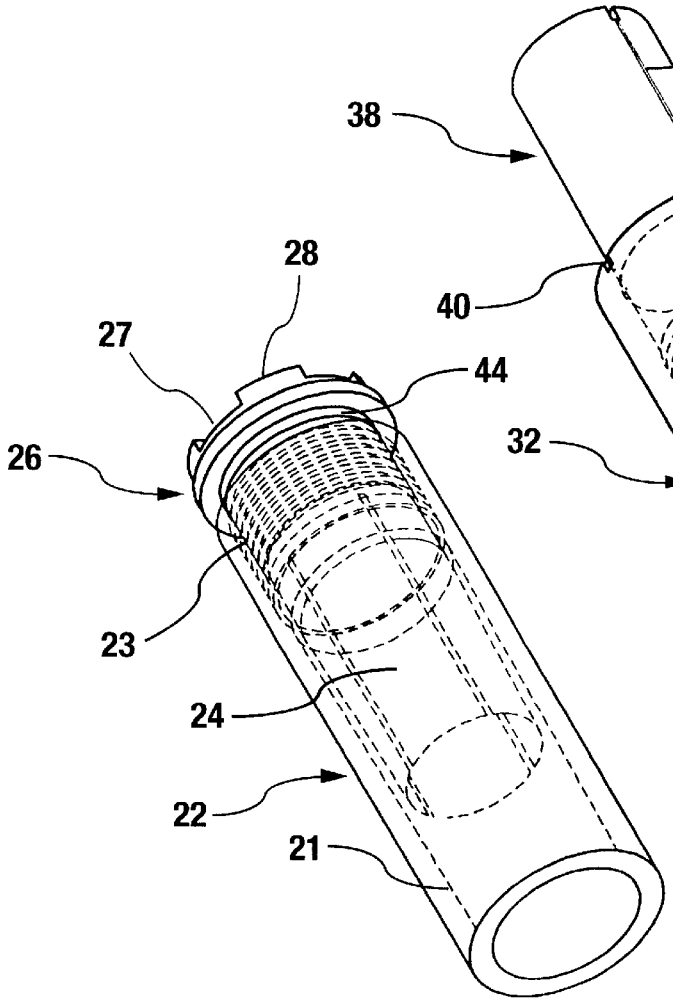
FIG. 1*a* shows a 3D view of the parts of the invention as they appear when assembled.

FIG. 1*a* is a three dimensional drawing that depicts the assembly of the collar 22 to the insert 26 and the assembly of the adjusting tool 32 and the pilot rod 38.

Figures 1, 1A, 2:
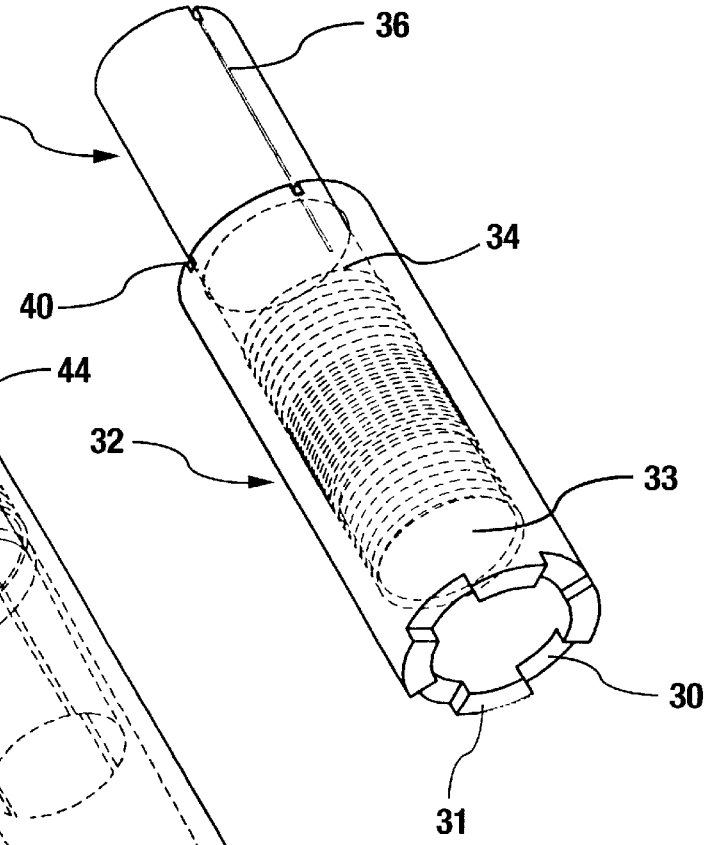
FIG. 2 depicts a cutaway side view of the tuning device as mounted on a gun barrel.
Figure 2:
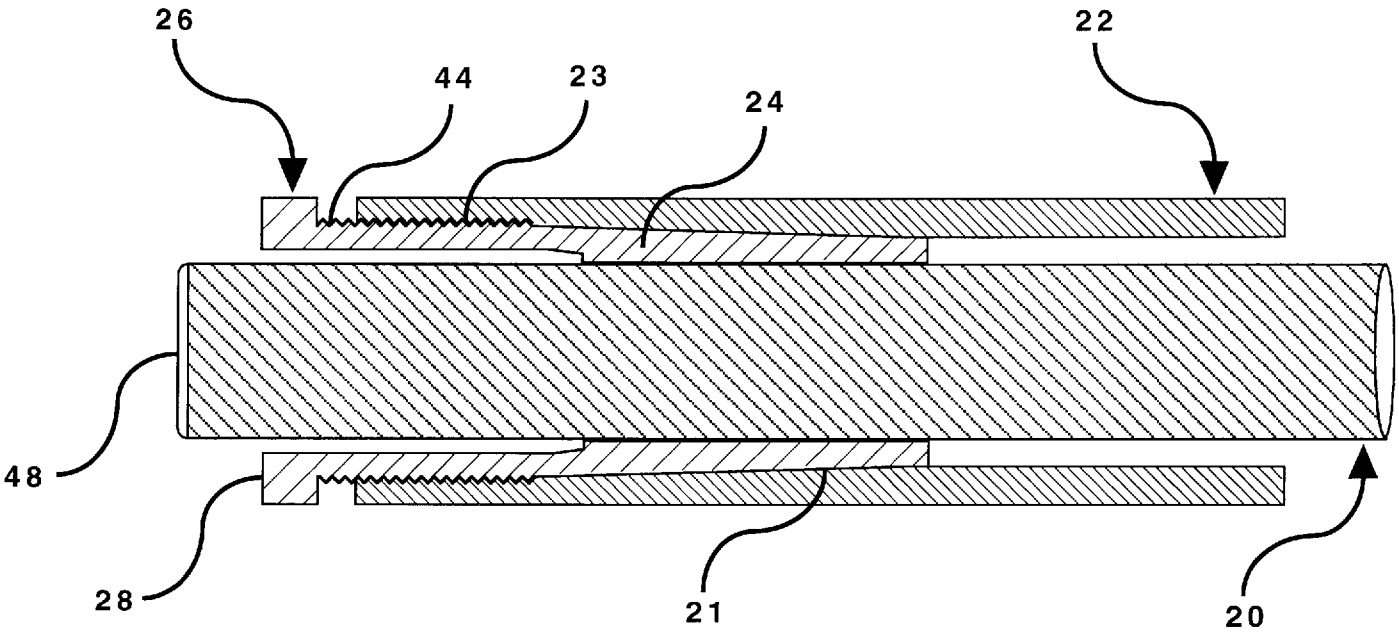

FIG. 2 depicts the collar 22 and compression insert 26 as mounted on a gun barrel 20 showing the collar 22 tightened onto the compression insert 26. The compression petals 24 are forced against the gun barrel 20 tightly by the internal taper 21 of the collar.

Figure 3:
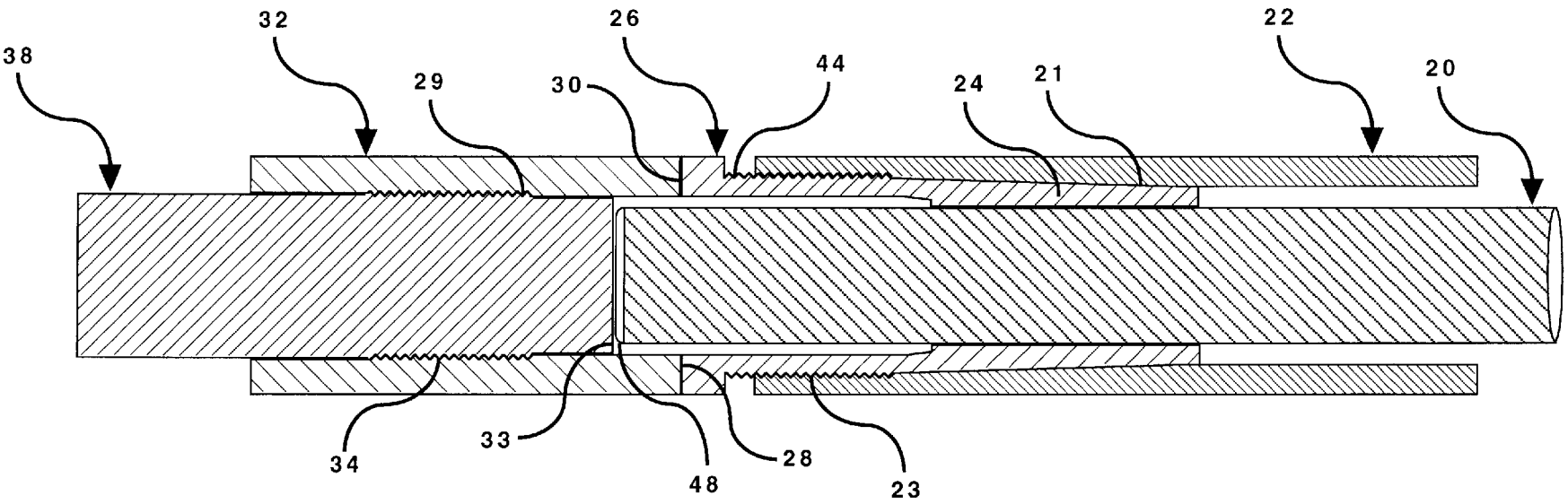
FIG. 3 depicts a cutaway side view of the tuning device as mounted on a gun barrel in relation to the adjusting tool.
Figure 4A:
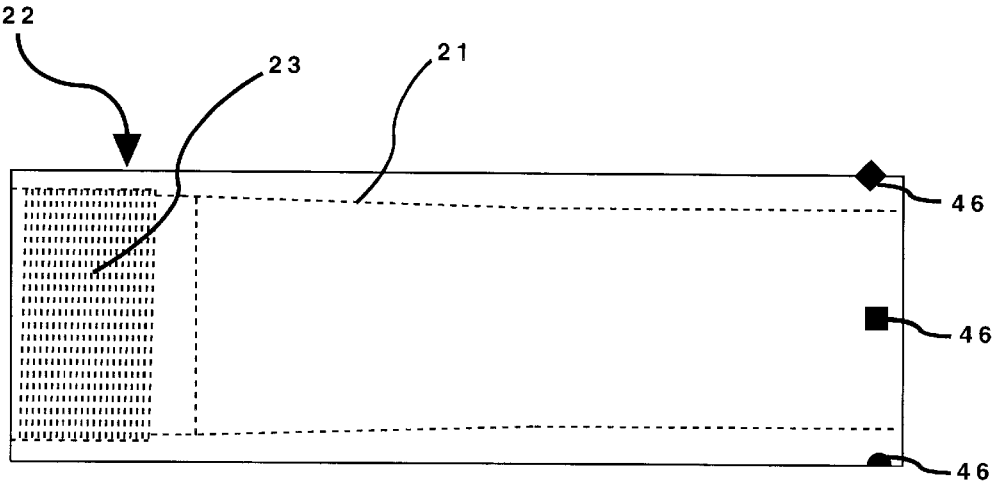
FIG. 4 shows a side view of the individual parts with dotted lines representing internal features.
Figure 4B:
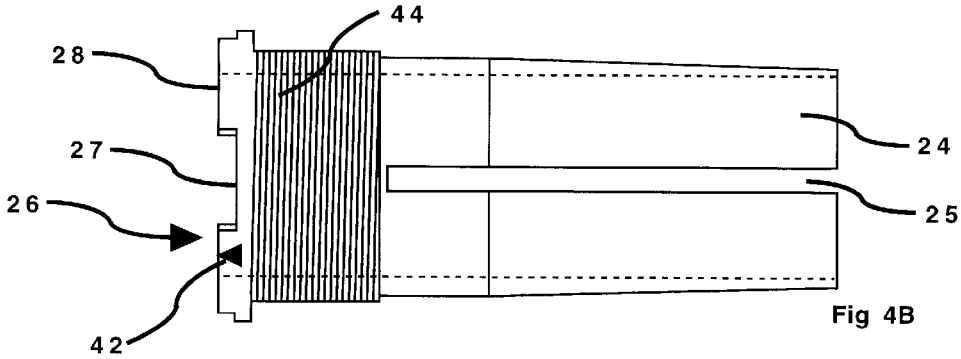
Figure 4C:
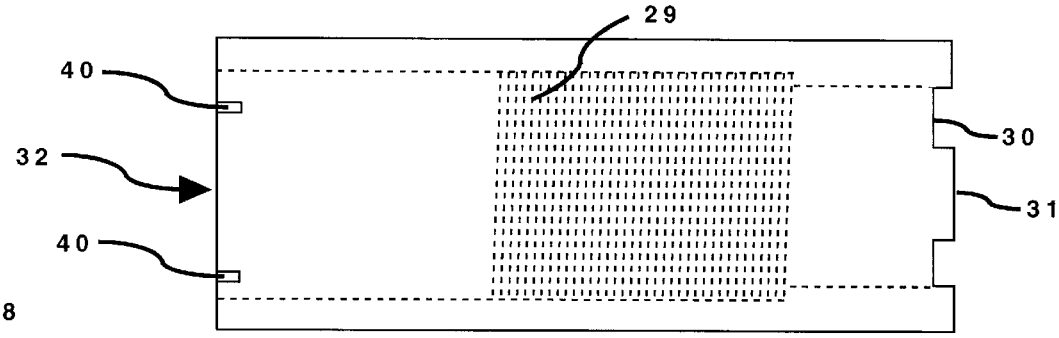
Figure 4D:
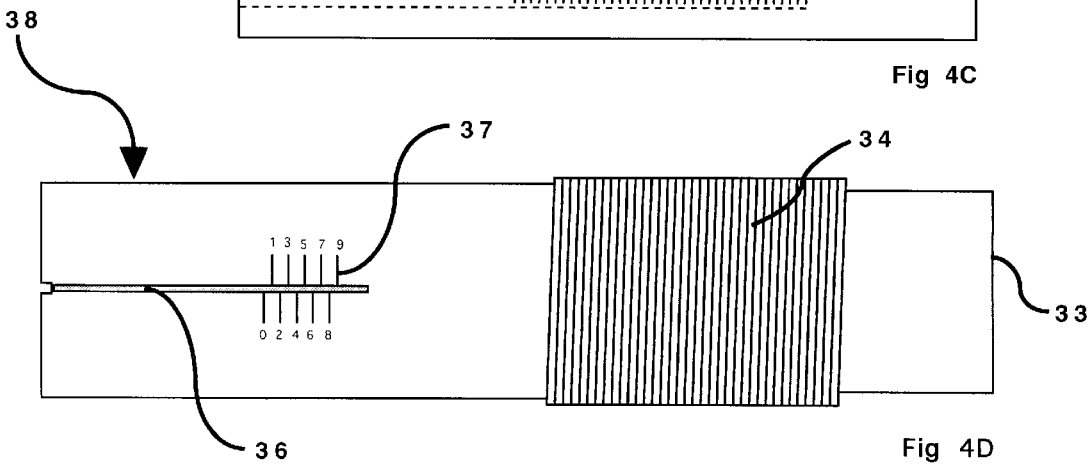

FIG. 3 depicts the relationship of the collar 22 and compression insert 26 to the adjusting tool 32 and adjusting tool pilot rod 38 as they relate to the mounting of the collar and compression insert on a gun barrel.

FIG. 4 shows side view drawings of the individual parts with internal features shown by dotted lines. The collar 22 has internal threads 23 and a tapered internal surface 21 as well as four reference points 46. The compression insert 25 has external threads 44, four or more tapered compression petals 24, 4 or more expansion slits 25, multiple slots 27 in the face 28, and a single reference point 42. The adjusting tool body 32 has internal threads 29, four index marks 40, multiple tabs 31 on the face 30. The pilot rod 38 has external threads 34, an adjustment reference mark, turn indicators 37, and a face 33.

DESCRIPTION—FIGURES 1–7 CONTINUED

Figure 5:
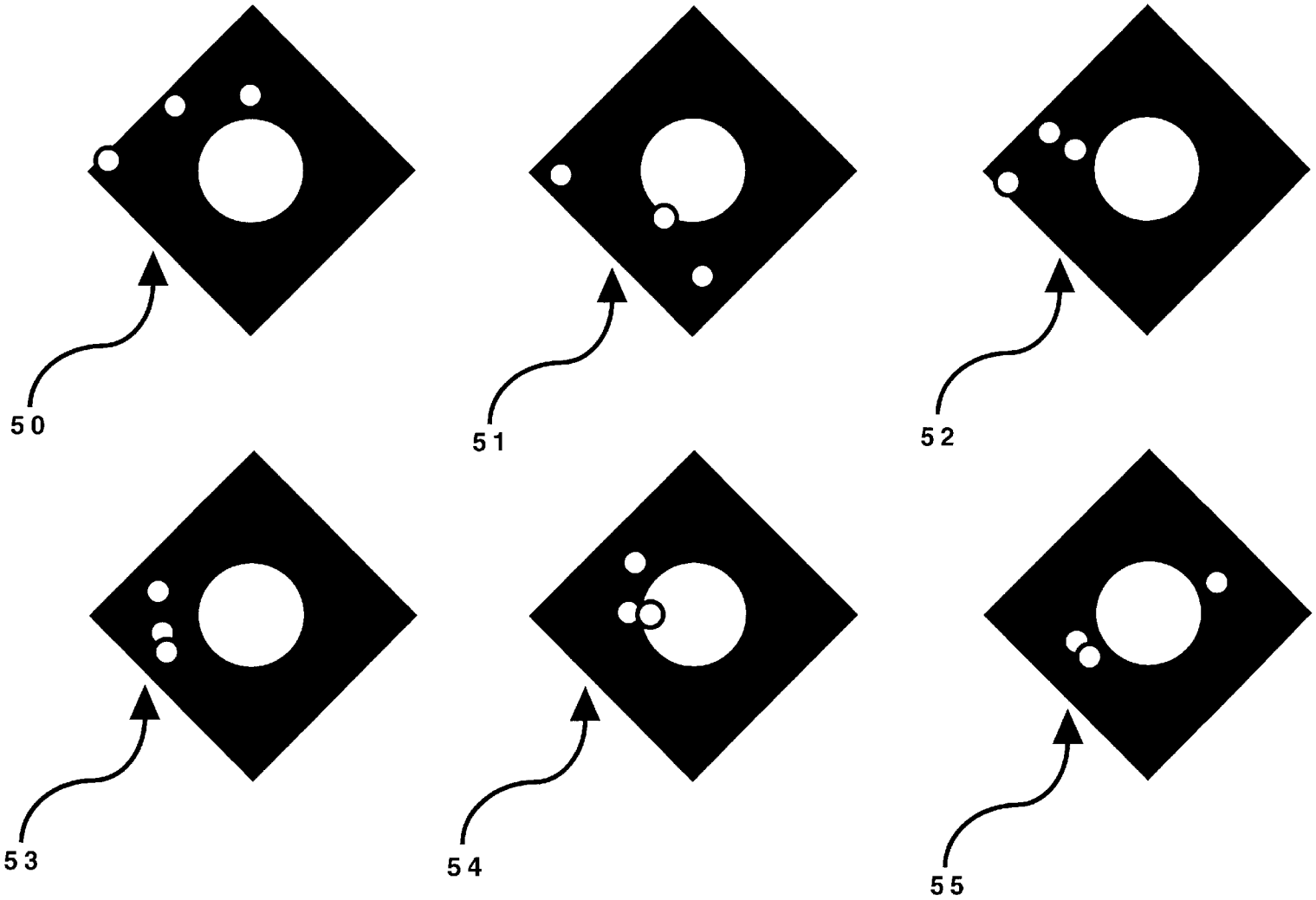
FIG. 5 shows actual test targets reproduced at 70% size illustrating the results of the invention as mounted on a Remington 788 Rifle, 22-250 Caliber, using Winchester 55 grain ammunition.

FIG. 5 shows reproductions of test targets shot with a 22-250 cal rifle. Target 50 was shot with no device, target 51 was shot with the device even with the muzzle (no adjustment), target 52 was shot with the device adjusted ½ turn, Target 53 was shot with the device adjusted 1 turn, Target 54 was shot with the device adjusted 1 & ½ turns, and target 55 was shot with the device adjusted 2 turns.

Figure 6:
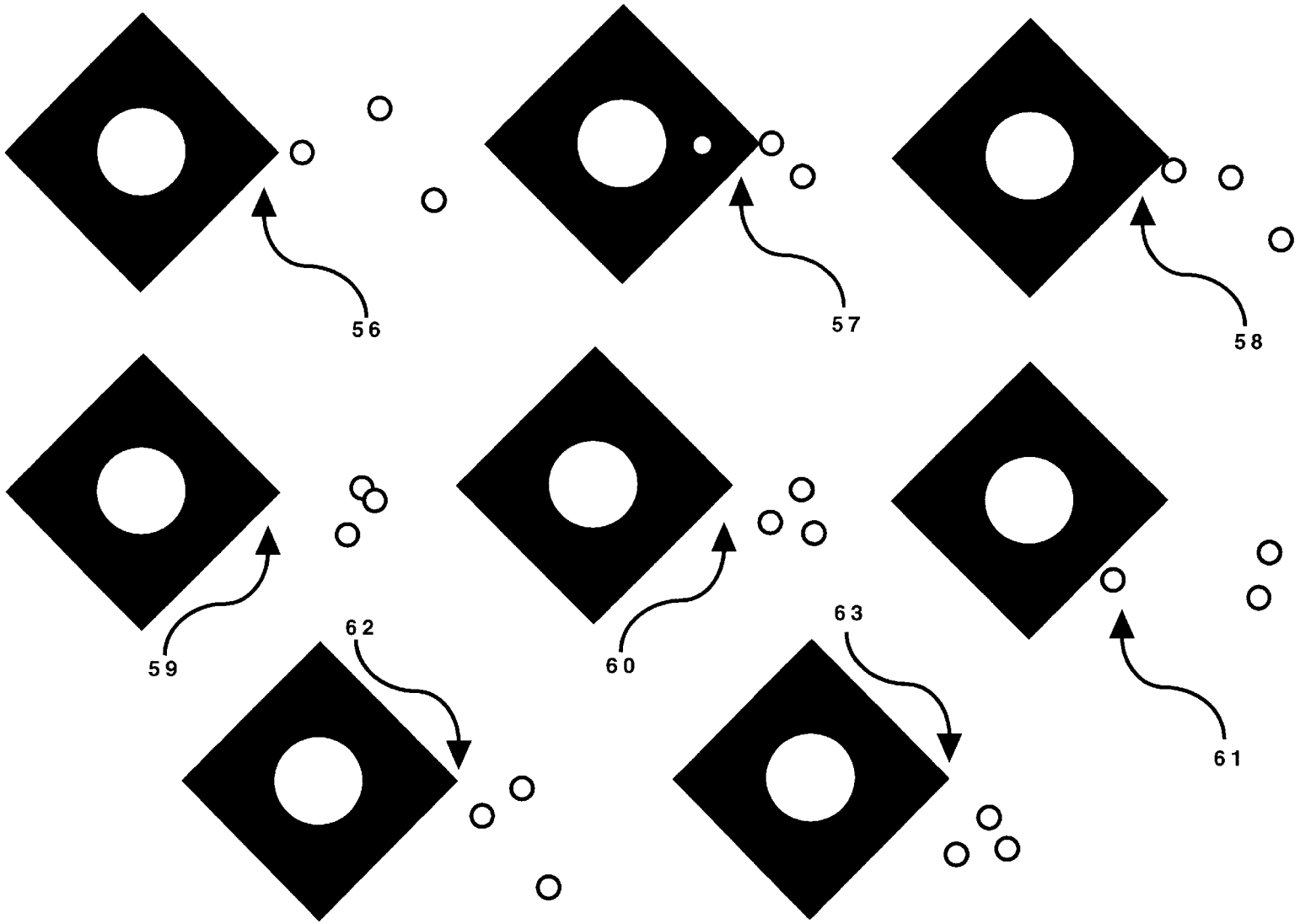
FIG. 6 shows actual test targets reproduced at 70% size illustrating the results of the invention as mounted on a Mauser 98 Rifle, 220 Swift caliber, using Winchester 55 Grain ammunition.

FIG. 6 shows reproductions of test targets shot with a 220 swift cal. rifle. Target 56 was shot with no device, target 57 was shot with the device mounted even with the muzzle (no adjustment), target 58 was shot with the device adjusted 1 & ½ turn, target 59 was shot with the device adjusted 1 turn, target 60 was shot with the device adjusted 1 & ¼ turn, target 61 was shot with the device adjusted 1 & ½ turn, target 62 was shot with the device adjusted 2 turns, and target 63 was shot with the device adjusted back to 1 turn.

Figure 7:
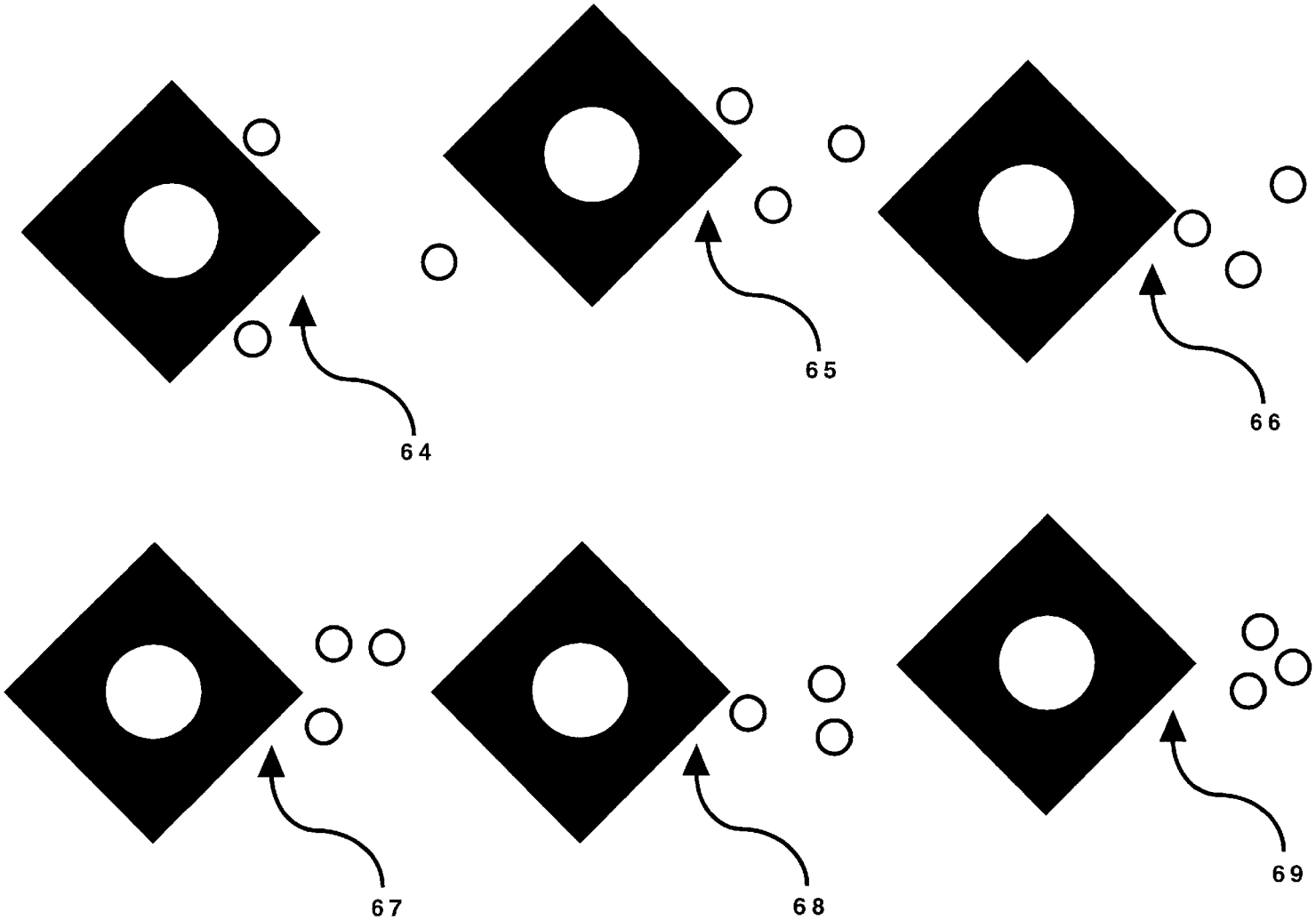
FIG. 7 shows actual test targets reproduced at 70% size illustrating the results of the invention as mounted on a Remington 742 Rifle, 30-06 caliber, using Remington 150 Grain ammunition.

FIG. 7 shows reproductions of test targets shot with a 30-06 cal. rifle. Target 64 was shot with no device, target 65 was shot with the device even with the muzzle (no adjustment), target 66 was shot with the device adjusted ½ turn, target 67 was shot with the device adjusted 1 turn, target 68 was shot with the device adjusted 1 & ½ turn, and target 69 was shot with the device adjusted 1 & ¾ turn.

OPERATION—FIGURE 1*a*, 2 & 3, 5, 6, & 7

The harmonic vibration characteristics of a gun barrel are altered by the invention in the following manner. The Collar 22 which provides the predetermined mass necessary to after barrel vibration patterns has internal threads 23 that engage external threads 44 on the compression insert 26. The compression insert 26 is made of a resin based material that will not mar or mark a gun barrel and which is flexible yet strong enough to allow tightening of the collar 22 which threads onto the compression insert 26. The compression insert and collar are slid axially onto a gun barrel 20. When the collar is tightened onto the compression insert, the tapered section 21 of the collar forces the petals 24 of the compression insert tightly against the gun barrel. The predetermined angle of the tapered section allows the compression insert to fit a variety of different barrel diameters. This results in the need for only a few different internal diameters on the inserts to fit barrels ranging from 0.490" in diameter to 0.700" in diameter. Once tightened sufficiently, the collar and compression insert will remain in place on the gun barrel during the recoil of firing.

There are 4 reference points 46 on the collar that relate to one reference point 42 on the insert. These reference points allow the collar and insert to be tightened to the same point each time. Tightening the collar and insert to t he same point each time insures consistent pressure on the petals and consistent tuning when the device is moved from one location to another on the barrel.

Moving the collar and insert axially along the gun barrel to different positions changes the harmonic vibration pattern of the barrel. The positioning of the collar and insert are determined by the adjusting tool 32. The adjusting tool has a pilot rod 38 that is threaded into the adjusting tool body. The face 30 of the adjusting tool has tabs 31 that mate with slots 27 on the face 28 of the compression insert. The mating of the slots of the insert to the tabs of the adjusting tool allow the adjusting tool to hold the compression insert in place as the collar is tightened onto it. The relative position of the collar and insert on the gun barrel is determined by the adjustment of the pilot rod in the adjusting tool. The face 33 of the pilot rod bears against the muzzle crown 48 of the gun when the adjusting tool is used to hold the insert in place while tightening the collar. If the pilot rod face is even with the face 30 of the adjusting tool when the collar and insert are tightened, the location of the collar & insert will be even with the muzzle. To move the collar and insert farther away from the muzzle (rearward), the pilot rod is turned counter clockwise allowing the adjusting tool to push the insert and collar away from the muzzle. The Pilot rod has turn indicator markings 37 to show the number of turns of adjustment. The turn indicator markings relate to four index marks 40 on the adjusting tool body. Each ¼ turn of the pilot rod in either direction will move the collar and insert a predetermined distance axially along the barrel.

The test targets shown in FIGS. 5, 6, and 7 show the changes in accuracy of 3 different test guns based on the number of counter clockwise turns of the pilot rod in the adjusting tool. As can be seen from these targets, it does not take very much movement of the collar and insert to change the accuracy of the load being tested. Removing the collar and insert and then subsequently placing it back on the barrel at the same point has been tested and the accuracy results are the same.

Extensive testing has shown that adjustments of the collar and insert axially along the barrel as little as 0.010" can significantly alter the accuracy characteristics of a gun. It has also been determined that there can be as many as 4 or 5 different optimum tuning points within as little as ½" of movement of the collar and insert axially along the gun barrel.

SUMMARY, RAMIFICATIONS, AND SCOPE

Thus the reader will see that the present invention provides a removable harmonic tuning system for firearms that any shooter will be able to install and use on a wide variety of firearms without having to purchase more systems for each firearm because it is transportable from one firearm to another without any permanent modifications or damage which can affect the value of the firearm. The removable harmonic tuning system has additional advantages in that

- The design of the inserts allows one size to fit a wide variety of barrel diameters;
- The system will not affect the value of any firearm it is mounted on;
- The system does not require any custom fitting hardware or require professional installation;
- The system will not increase the overall length of a firearm because it is mounted behind the muzzle;
- Because the system is mounted behind the muzzle, the muzzle dynamics are not affected. As the bullet leaves the barrel, there are no additional appendages or devices extending beyond the muzzle which will affect the gas escaping behind the bullet. Thus no gases which escape diagonally outward behind the bullet can be deflected back toward the bullet thereby affecting accuracy;
- Being mounted behind the muzzle means that there is no change in the noise level of the muzzle blast;
- The complete mounting and adjusting operation of the system including the collar, insert, and adjusting tool do not require the use of any additional tools for manipulation;
- On all common barrel diameters used for sporting firearms, the slots between the petals on the insert will allow air to circulate between the barrel and the collar and insert. This will insure adequate barrel cooling near the muzzle. This space for air circulation will also allow room for expansion of the collar and insert due to heat buildup from firing;
- The overall diameter of the system when mounted on a firearm barrel will not interfere or impede with the use of telescopic sights;
- The system works without the need for any special stock bedding compound or alterations;

Although the previous descriptions contain many specific details concerning the design of the invention, these should not be construed to limit the scope of the invention, but should be considered as the preferred illustrations of the invention. For example, the collar does not necessarily have to be a round tubular shape on the outside, but could in fact be multifaceted, or octagonal. All the markings and indexes could be represented in different ways or with different symbology. The insert could be threaded differently and the taper of the compression petals and the inside of the collar could be reversed. The method of adjustment could be contained within the collar and insert by the inclusion of an inner adapter between the collar and insert which would allow the collar to be adjustably moved without having to move the insert as well. The face of the insert and adjusting tool could have any number of different mating surfaces other than the tabs and slots illustrated so long as the adjusting tool and insert mated securely.

With these variations in mind, the scope of the invention should be determined by the attached claims and their equivalents, rather than solely on the examples given.

What is claimed is:

1. A removable harmonic tuning system for firearms comprising:

a. an internally tapered and internally threaded tubular shaped collar of a predetermined mass, and b. a tubular shaped insert of a flexible composition that fits inside said collar and is externally threaded on one end and externally tapered on the opposite end with a plurality of lengthwise slits in said externally tapered area, and c. a tubular shaped tool which has means of mating with said insert and provides an adjustable means of positioning said insert when the insert and the collar are placed over a firearm barrel near the muzzle with said firearm barrel passing through the center of the insert, whereby the harmonic vibration pattern of said firearm barrel can be tuned by moving the said predetermined mass of the collar and the insert to different locations along the axis of the firearm barrel to a position that promotes the greatest accuracy and thence locked in place by tightening the collar onto the insert while it is held at said position by said tool so that the said internally tapered area of the collar bears upon the externally tapered area of the insert causing the insert to firmly grasp the firearm barrel.

2. The removable harmonic tuning system for firearms of claim 1 wherein the predetermined angle of the externally tapered area of the insert will allow the insert to fit a multitude of firearm barrels of different diameters.

3. The removable harmonic tuning system for firearms of claim 1 wherein said flexible composition of the insert is such that it precludes the possibility of damage to a firearm barrel and leaves no marks or marring when removed from a firearm barrel.

4. The removable harmonic tuning system for firearms of claim 1 wherein the collar and insert remain behind the muzzle when mounted on a firearm barrel.

5. The removable harmonic tuning system for firearms of claim 1 wherein said adjustable means of the tool is such that it will allow the removal of the collar and insert from the firearm barrel and later reattachment at the same point of adjustment by means of a predetermined method of calibration.

6. The removable harmonic tuning system for firearms of claim 1 wherein the mounting position of the collar and insert preclude any increase in noise levels associated with the discharge of a firearm.

7. The removable harmonic tuning system for firearms of claim 1 wherein said lengthwise slits in the externally tapered area of the insert allow cooling air to circulate between the firearm barrel and the insert.

8. The removable harmonic tuning system for firearms of claim 1 wherein the said harmonic tuning system can be manipulated without any additional tools.

9. The removable harmonic tuning system for firearms of claim 1 wherein the diameter of the collar precludes extension into the line of sight of any telescopic sighting system that is conventionally mounted on the firearm by any standard receiver telescopic mounting system.

10. The removable harmonic tuning system for firearms of claim 1 wherein the need for machining, threading, drilling, or other such modifications to the firearm barrel are precluded in order for the collar and insert to be mounted on the firearm barrel.

11. A removable harmonic tuning system for firearms comprising:

a. an internally threaded tubular shaped collar of predetermined mass having a tapered internal cavity, and b. a tapered elongated cylindrical shaped insert of resilient resin based material externally threaded to mate with the internal threads of said collar and having evenly spaced longitudinal slits of a predetermined dimension, and c. an elongated cylindrical shaped tool having means to mate with said insert that provides adjustment when the insert and collar are placed over a firearm barrel near the muzzle, whereby the positioning of the collar and insert at various locations along the axis of said firearm barrel tunes the harmonic vibration pattern set forth by a discharge of ammunition once the collar and insert are locked in place on the firearm barrel by tightening the collar onto the insert while being held in place by said tool whereby said tapered internal cavity of the collar forces the insert to compress tightly against the entire circumference of the firearm barrel.

12. The removable harmonic tuning system for firearms of claim 11 wherein a predetermined longitudinally tapered area of the insert and said evenly spaced longitudinal slits allow the insert to accommodate a multitude of firearm barrels.

13. The removable harmonic tuning system for firearms of claim 11 wherein the composition of the insert is such that after repeated mounting and dismounting does not harm or alter the surface finish of the firearm barrel.

14. The removable harmonic tuning system for firearms of claim 11 wherein neither the collar or insert extends beyond said muzzle of the firearm barrel.

15. The removable harmonic tuning system for firearms of claim 11 wherein the said adjustment of the tool is such that it will allow the removal of the collar and insert from the firearm barrel and later reattachment at the same point of adjustment by means of a predetermined method of calibration.

* * * * *